US006926383B2

(12) United States Patent
Chang

(10) Patent No.: US 6,926,383 B2
(45) Date of Patent: Aug. 9, 2005

(54) CARRIER LOCKING APPARATUS FOR INKJET PRINTER

(75) Inventor: Deuk-hwan Chang, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/460,168

(22) Filed: Jun. 13, 2003

(65) Prior Publication Data

US 2004/0095416 A1 May 20, 2004

(30) Foreign Application Priority Data

Nov. 19, 2002 (KR) ..... 10-2002-0071970

(51) Int. Cl.[7] ..... B41J 2/165

(52) U.S. Cl. ..... 347/32; 347/29; 347/30; 347/33

(58) Field of Search ..... 347/22, 29, 30, 347/32, 33, 37, 23, 53

(56) References Cited

U.S. PATENT DOCUMENTS 5,757,395 A * 5/1998 Chew et al. ..... 347/24

6,007,179 A * 12/1999 Ohtani et al. ..... 347/30

FOREIGN PATENT DOCUMENTS

| | | |
|---|---|---|
| JP | 63-9548 | 1/1988 |
| JP | 4-371849 | 12/1992 |
| JP | 08025280 | * 3/1996 |
| JP | 2001-71517 | 3/2001 |
| KR | 2000-13010 | 3/2000 |

* cited by examiner

*Primary Examiner*—Shih-Wen Hsieh
(74) *Attorney, Agent, or Firm*—Staas & Halsey LLP

(57) ABSTRACT

A carrier locking apparatus of an inkjet printer having: a latch groove on a moving carrier carrying an ink cartridge; a locking lever, installed at a home position of the carrier, with a first end having a latch, and a second end having a pivoting lever; and a toggle spring joined to the locking lever's second end selectively applying elastic force to the locking lever to maintain each of two pivoted states. When the carrier moves to the home position, the carrier pushes the pivoting lever to pivot the locking lever in a first direction, inserting the latch into the latch groove to lock the carrier. When the carrier moves from the home position, the locking lever pivots in a second direction opposite the first direction, the latch disengages from the latch groove to unlock the carrier, and the locking lever pivots in the second direction.

33 Claims, 8 Drawing Sheets

CARRIER LOCKING APPARATUS FOR INKJET PRINTER

CROSS-REFERENCE TO RELATED APPLICATIONS

This application claims the benefit of Korean Patent Application No. 2002-71970, filed Nov. 19, 2002, in the Korean Intellectual Property Office, the disclosure of which is incorporated herein by reference.

BACKGROUND OF THE INVENTION

1. Field of the Invention

The present invention relates to an inkjet printer, and more particularly, to a carrier locking apparatus for an inkjet printer, to lock a carrier, in which at least one ink cartridge is mounted, in a home position, to withstand external impact or vibration.

2. Description of the Related Art

In general, an inkjet printer is a printer in which an image is formed on a recording medium by jetting ink droplets onto the recording medium from at least one ink cartridge mounted in a carrier that reciprocates perpendicularly to the transfer direction of the recording medium. In particular, in a color inkjet printer, a mono-cartridge containing a black ink, and color cartridges containing various color inks, for example, cyan, magenta, and yellow, are mounted in a carrier, and a color image can be printed by combining these color inks.

FIG. 1 is a perspective view illustrating a conventional carrier of an inkjet printer, a carrier moving apparatus, and a carrier parking apparatus, and FIG. 2 is an enlarged perspective view illustrating the carrier parking apparatus of FIG. 1.

Referring to FIGS. 1 and 2, an inkjet printer has a carrier 10 for reciprocating ink cartridges 12 mounted therein. The carrier 10 is moved by a carrier belt 40, and guided by a guide shaft 30. The carrier belt 40 is wound around a driving pulley 42 and a driven pulley 46, and a portion of the carrier belt 40 is held by a belt holder (not shown) provided at the rear side of the carrier 10. The driving pulley 42 is connected to and driven by a rotation shaft of a driving motor 44 to circulate the carrier belt 40. The circulation direction of the carrier belt 40 is changed according to the rotation direction of the driving pulley 42. When the carrier belt 40 circulates, the carrier 10 moves linearly along the guide shaft 30. Reference numeral 48 denotes a spring that applies a predetermined tensional force to the carrier belt 40.

When the printer is not in operation, the carrier 10 is parked at a home position provided at one end portion of the inkjet printer. A parking apparatus 50 is provided at the home position, and caps 55 are installed at the parking apparatus 50 to cover respective head chips 14 (FIG. 3A) provided at the lower surfaces of the ink cartridges 12. Each head chip 14 has a plurality of nozzles for jetting ink, and when the carrier 10 is parked at the home position, the caps 55 cover the respective head chips 14. Once the cap 55 covers the head chip 14, ink leakage from the nozzles of the head chip 14 is prevented since the internal pressure of the cap 55 is regulated to be the same as or higher than the internal pressure of the ink cartridge 12. Additionally, the cap 55 seals the head chip 14 from external air to prevent ink from clotting due to the evaporation of a volatile constituent of ink.

The parking apparatus 50 has an external frame 51 installed at a main frame 20 of the printer, and an internal frame 54 joined to the external frame 51 to move up and down along a predetermined path. Wipers 56 are installed at upper portions of the internal frame 54 to clean the respective surfaces of the head chips 14. Guide grooves 53 serving as the predetermined path are located on the external frame 51, and guide pins 57, installed at the internal frame 54, are inserted into the guide grooves 53. In addition, a parking lever 58 and an un-parking lever 59 are provided at opposing ends of the internal frame 54.

The operation of the conventional parking apparatus having the above-described structure is now described with reference to FIGS. 3A and 3B.

Referring to FIG. 3A, when the printer is operating, the carrier 10 is out of the home position, and the internal frame 54 of the parking apparatus 50 is maintained in a lowered state due to an elastic force of a spring 60. Additionally, the guide pins 57 of the internal frame 54 are positioned at lower end portions of the guide grooves 53 of the external frame 51.

When a printing job is completed, the carrier 10 moves in the direction of arrow R and pushes the parking lever 58. Accordingly, the guide pins 57 move upward along the paths of the respective guide grooves 53, and the internal frame 54 and the caps 55 move upward simultaneously. As shown in FIG. 3B, when the carrier 10 reaches the home position, the caps 55 are raised completely, and cover the respective head chips 14 of the ink cartridges 12. Further, the guide pins 57 of the internal frame 54 are positioned at upper end portions of the respective guide grooves 53 of the external frame 51.

When a printing operation is requested when the carrier 10 is parked at the home position, the carrier belt 40 is circulated by the operation of the driving motor 44, and the carrier 10 moves in the direction of arrow F along the guide shaft 30. Accordingly, the internal frame 54 is moved downward by the elastic force of the spring 60, the guide pins 57 move downward along the paths of the respective guide grooves 53, and the caps 55 move downward and separate from the head chips 14. The surfaces of the head chips 14 are cleaned by the wipers 56 when the guide pins 57 are positioned at middle portions of the guide grooves 53. Thereafter, as shown in FIG. 3A, when the carrier 10 is completely out of the home position while pushing the un-parking lever 59, the internal frame 54 is completely lowered due to the elastic force of the spring 60. Further, the guide pins 57 of the internal frame 54 are positioned at the lower end portion of the respective guide grooves 53 of the external frame 51.

In the conventional parking apparatus 50 described above, however, when an external impact or vibration is applied to the carrier 10, the carrier 10 may be easily separated from the parking apparatus 50. Further, the head chips 14 may separate from the respective caps 55, and accordingly ink may leak from the nozzles of the head chips 14. The leaked ink may cause the transfer path of a recording medium to be contaminated, and reduce the quality of printing. In addition leaked ink reduces a useful life of the ink cartridge 12. Further, when the head chips 14 are exposed, the head chips 14 may be contaminated by dust or the like, and ink may clot in the nozzles due to the evaporation of the volatile constituent of ink and block the nozzles. Further still, if the nozzles are blocked, ink will not jet through the nozzles properly, and the quality of printing deteriorates further. Also, when the carrier 10 is separated from the home position and allowed to rattle freely, the carrier 10 and the head chips 14 may be easily damaged.

SUMMARY OF THE INVENTION

To solve the above-described problems, it is an aspect of the present invention to provide a carrier locking apparatus for an inkjet printer to lock a carrier parked at a home position, and prevent the carrier from separating from a parking apparatus provided at the home position despite external impacts or vibrations of a predetermined magnitude.

Accordingly, to achieve the above and/or other aspects, there is provided a carrier locking apparatus of an inkjet printer, including a reciprocally moving carrier carrying an ink cartridge, and a parking apparatus provided at the home position, the carrier locking apparatus having: a latch groove provided at a predetermined location on the carrier; a locking lever, which is installed at the parking apparatus and has a first end provided with a latch, and a second end provided with a pivoting lever; and a toggle spring joined to the second end of the locking lever to apply an elastic force to the locking lever to selectively maintain each of two pivoted states of the locking lever, wherein when the carrier moves to the home position, the carrier pushes the pivoting lever and pivots the locking lever in a first direction to insert the latch into the latch groove to lock the carrier, and when the carrier moves from the home position, the locking lever pivots in the direction opposite the first direction, and disengages the latch from the latch groove to unlock the carrier.

According to one aspect, a metal plate is provided at the second end of the locking lever, and an electromagnet is provided to selectively attract the metal plate and pivot the locking lever in the first direction to lock the carrier.

According to one aspect, the second end of the locking lever has two prongs, each end of the toggle spring is connected to one of the two prongs, and a middle portion of the toggle spring contacts and is supported by a bracket installed at the main frame of the printer.

According to another aspect, there is provided a carrier locking apparatus of an inkjet printer including a reciprocally moving carrier carrying an ink cartridge, and a main frame, the carrier apparatus having: a hook provided at a first end of the carrier; a locking lever pivotably installed on the main frame, and provided with a metal plate at a first end; an electromagnet to selectively attract the metal plate to pivot the locking lever in a first direction; and an elastic member to bias the locking lever in a second direction opposite the first direction, wherein when the carrier moves to a home position, the metal plate is attracted to and contacts the electromagnet, the locking lever pivots in the first direction, and the hook engages a second end of the locking lever to lock the carrier, and when the carrier moves from the home position, the electromagnet disconnects from an electric power source, the locking lever is pivoted in the second direction by the elastic force of the elastic member, and the hook disengages from the second end of the locking lever to unlock the carrier.

According to one aspect, the electromagnet has two cores, a permanent magnet installed between the two cores, two bobbins surrounding the two cores, respectively, and two coils wound around circumferential surfaces of the bobbins.

According to one aspect, the electromagnet is configured so that when the electromagnet is not connected to an electric power source, a magnetic field of the permanent magnet around the leading ends of the cores attracts the metal plate to the leading ends of the cores, and when the electromagnet is connected to an electric power source, the magnetic field is offset.

According to one aspect, the electromagnet is fixedly installed at an outer side surface of the main frame, and the leading ends of the cores face the metal plate.

With the present invention, when the carrier is parked at the home position, the carrier is locked by the locking apparatus, and the carrier is prevented from moving from the home position despite external impacts or vibrations of predetermined magnitude applied to the carrier.

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which:

FIG. 4 shows a carrier positioned out of a home position, and FIG. 5 shows the carrier parked at the home position;

FIG. 7 shows a carrier parked at a home position, and FIG. 8 shows a carrier positioned out of the home position.

DETAILED DESCRIPTION

Figure 1:
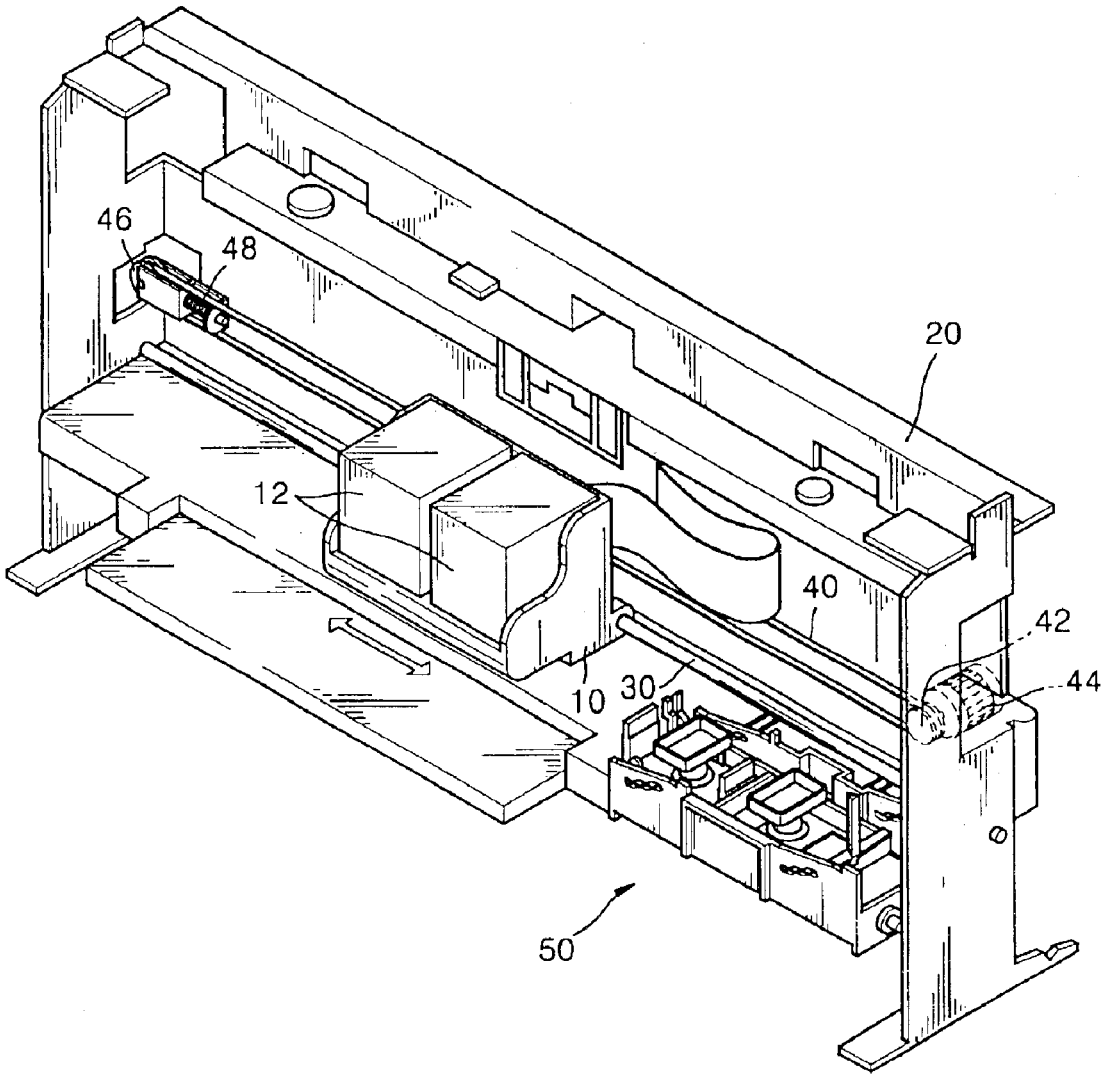
FIG. 1 (PRIOR ART)
FIG. 1 is a perspective view illustrating a conventional carrier for ink cartridges of an inkjet printer, a carrier moving apparatus, and a carrier parking apparatus.
Figure 2:
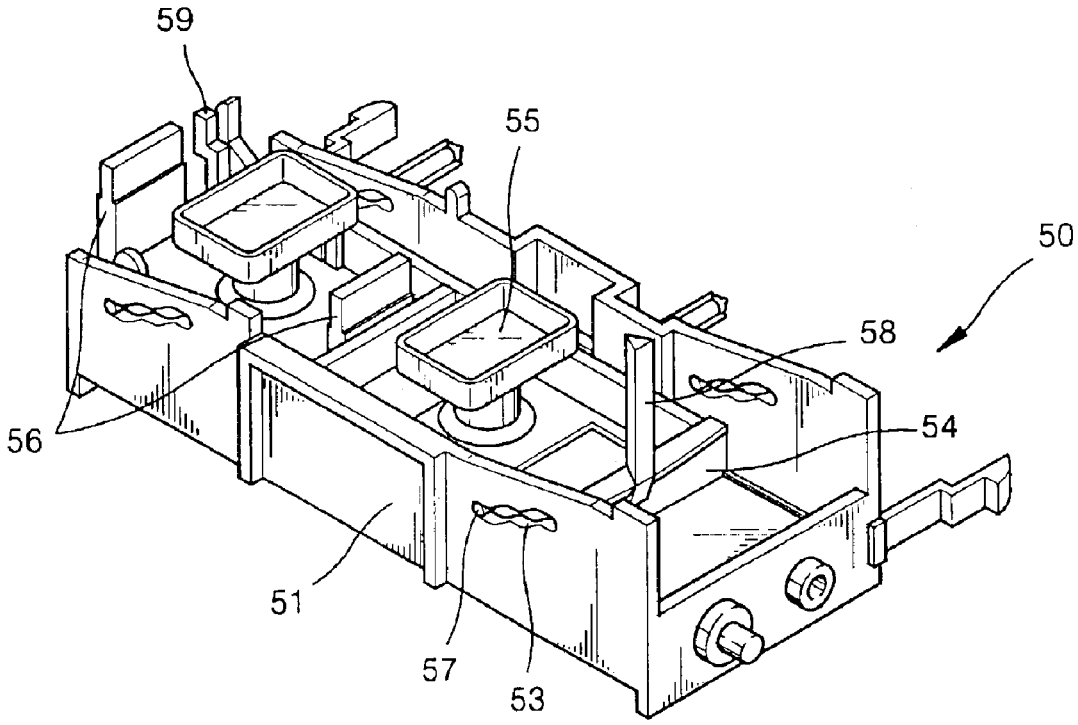
FIG. 2 (PRIOR ART)
FIG. 2 is an enlarged perspective view illustrating the carrier parking apparatus of FIG. 1.
Figure 3A:
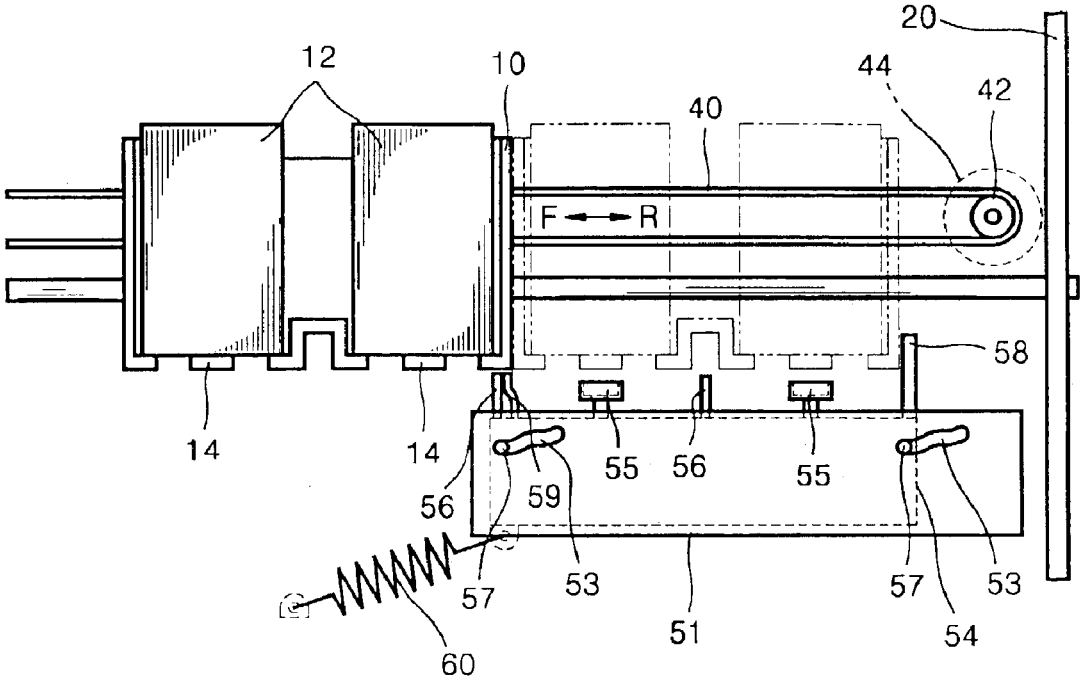
FIG. 3A (PRIOR ART)
FIGS. 3A and 3B are front views of the parking apparatus of FIG. 1.
Figure 3B:
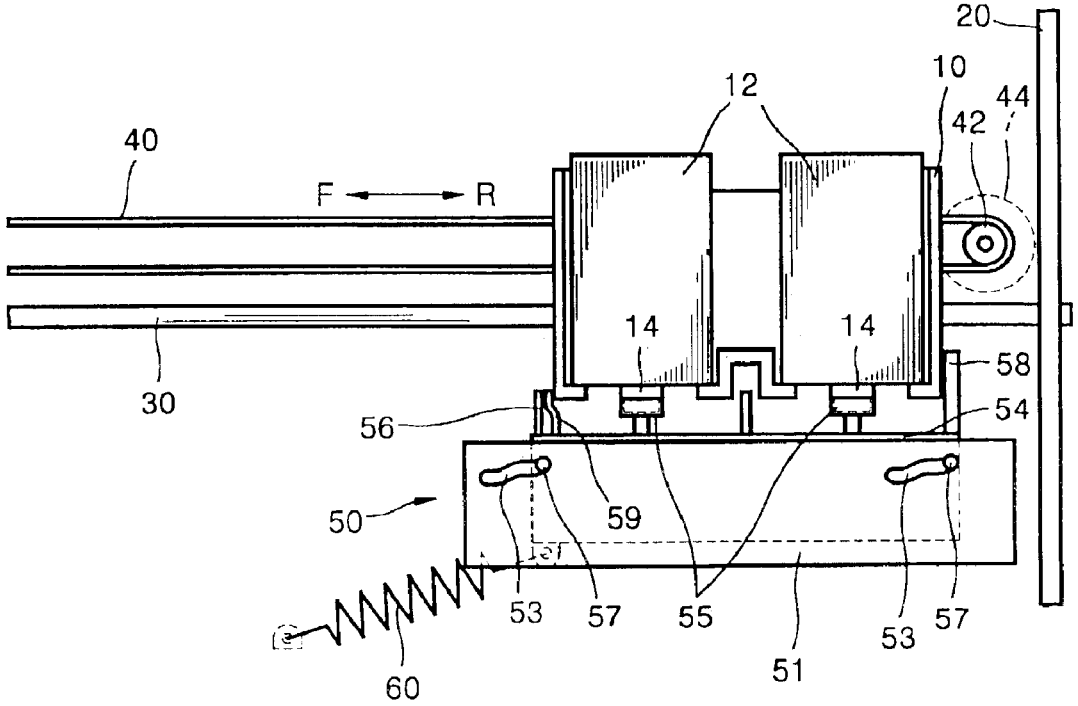
FIG. 3B (PRIOR ART)

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 4:
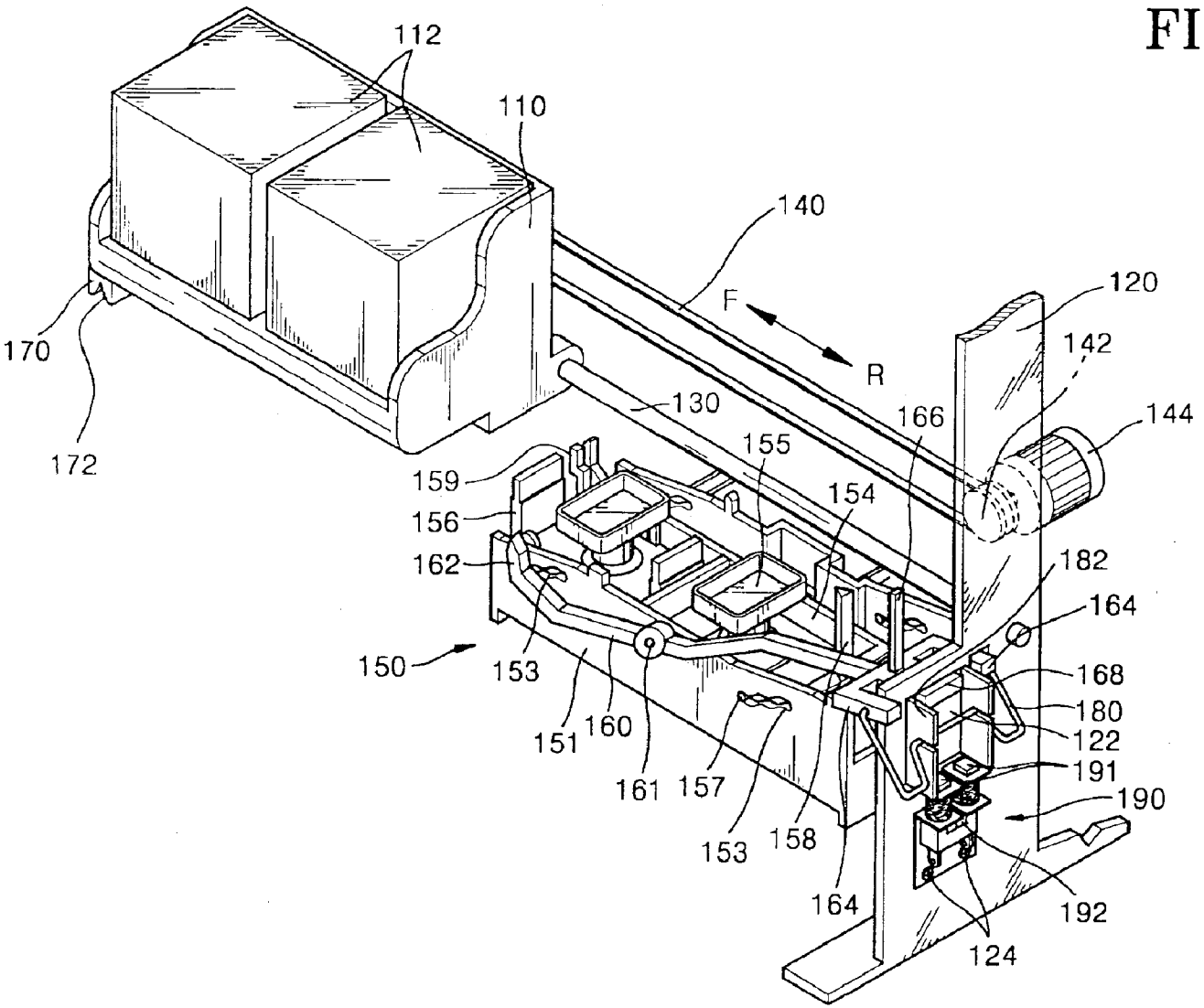
FIGS. 4 and 5 are perspective views illustrating a carrier locking apparatus of an inkjet printer according to a first embodiment of the present invention.
Figure 5:
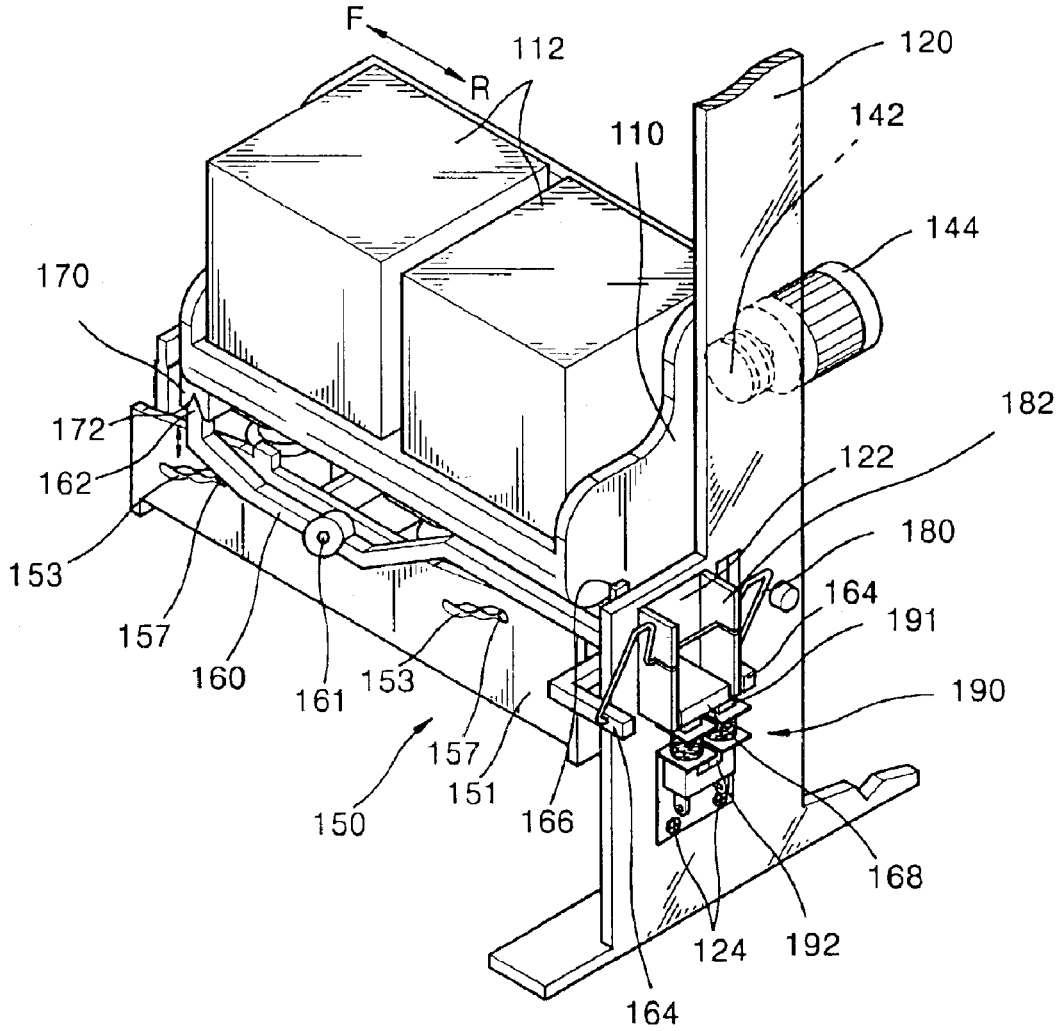

FIGS. 4 and 5 are perspective views illustrating a carrier locking apparatus of an inkjet printer according to a first embodiment of the present invention. FIG. 4 shows a carrier positioned out of a home position, and FIG. 5 shows the carrier parked at the home position.

Referring to FIG. 4, an inkjet printer has a carrier 110 for ink cartridges. According to one aspect, there are two cartridges: one of the two ink cartridges 112 is a mono-cartridge containing black ink, and the other is a color cartridge containing cyan, magenta, and yellow inks. According to another aspect however, each of color inks, i.e., cyan, magenta, or yellow ink is contained in a separate ink cartridge, thus, four ink cartridges would be mounted in the carrier 110.

To form an image on a recording medium by jetting ink onto a recording medium from the ink cartridges, a carrier moving apparatus is provided in the inkjet printer for reciprocating the carrier 110 in a direction perpendicular to a transfer direction of the recording medium. The carrier moving apparatus has a carrier belt 140 wound and circulating around a driving pulley 142, and a driven pulley (not shown) to move the carrier 110, a guide shaft 130 to guide the reciprocating movement of the carrier 110, and a driving motor 144 to rotate the driving pulley 142.

When the printer is not in operation, the carrier 110 is parked at a parking apparatus 150 provided at a home position. The structure of the parking apparatus 150 is similar to a conventional parking apparatus. That is, the parking apparatus 150 has an external frame 151 fixedly installed at a main frame 120 of the printer, and an internal frame 154 joined to the external frame 151 that moves up and down along a predetermined path, and has caps 155 and wipers 156 installed at upper portions thereof. Guide grooves 153 having a predetermined path located on the external frame 151, and guide pins 157 installed at the internal frame 154 are inserted into the guide grooves 153. In addition, a parking lever 158 and an un-parking lever 159 are located at opposing ends of the internal frame 154.

In addition, a carrier locking apparatus for locking the carrier 110 is provided to prevent the carrier 110 from being separated from the parking apparatus 150 when the carrier 110 is parked at the home position. The carrier locking apparatus has a locking lever 160 that pivots, installed on the external frame 151, a latch groove 172 provided at the carrier 110, and a toggle spring 180 joined to the rear end of the locking lever 160. According to one aspect, the carrier locking apparatus further comprises an electromagnet 190 to restrain the pivoting motion of the locking lever 160.

The locking lever 160 is assembled to a pivot pin 161 installed at the front surface of the external frame 151 at about the middle thereof. And a latch 162 having a sharp bevelled shape is provided at one end, i.e., a leading end of the locking lever 160. When the carrier 110 is parked at the home position, the latch 162 is inserted into the latch groove 172 so that the carrier 110 cannot be separated from the parking apparatus 150. The latch groove 172 is located at a predetermined position, for example, the front left edge of the carrier 110, and has a shape that complements the latch 162. According to one aspect, the latch groove 172 is located on the carrier 110 itself. According to another aspect, as shown in FIG. 4, the latch groove 172 is located on a latch groove member 170 that is attached to the carrier 110. According to yet another aspect, the latch groove member 170 is an integrated part of the carrier 110.

A pivoting lever 166 projects upward at an other end, i.e., a rear end, of the locking lever 160. When the carrier 110 moves toward the home position, the pivoting lever 166 is pushed in the direction of arrow R by the carrier 110. Accordingly, the locking lever 160 pivots around the pivot pin 161 by a predetermined angle.

In addition, the rear end of the locking lever 160 has two prongs 164, and two ends of the toggle spring 180 are joined to the two prongs 164. An intermediate portion of the toggle spring 180 is joined to and supported by a bracket 182, which is attached to an external side surface of the main frame 120. When the rear end of the locking lever 160 is in the raised state, as shown in FIG. 4, the toggle spring 180 applies an elastic force to the rear end of the locking lever 160 to maintain the raised state. And when the rear end of the locking lever 160 is in the lowered state, as shown in FIG. 5, the toggle spring 180 applies elastic force to the rear end of the locking lever 160 to maintain the lowered state. Thus, the rear end of the locking lever 160 is maintained in the raised and lowered states by the toggle spring 180, and therefore, free pivoting of the locking lever 160 is restrained by the toggle spring 180.

As noted above, according to one aspect, the carrier locking apparatus has the electromagnet 190. Further, a paramagnetic metal plate 168 is provided between the two prongs 164 of the rear end of the locking lever 160. The metal plate 168 projects outside of the main frame 120 through a hole 122 formed at the main frame 120. According to one aspect, the metal plate 168 is attached to the locking lever 160 as a separate member. According to another aspect, the locking lever 160 is made of paramagnetic metal, and the metal plate 168 and the locking lever 160 are constructed as an integrated member.

Figure 6A:
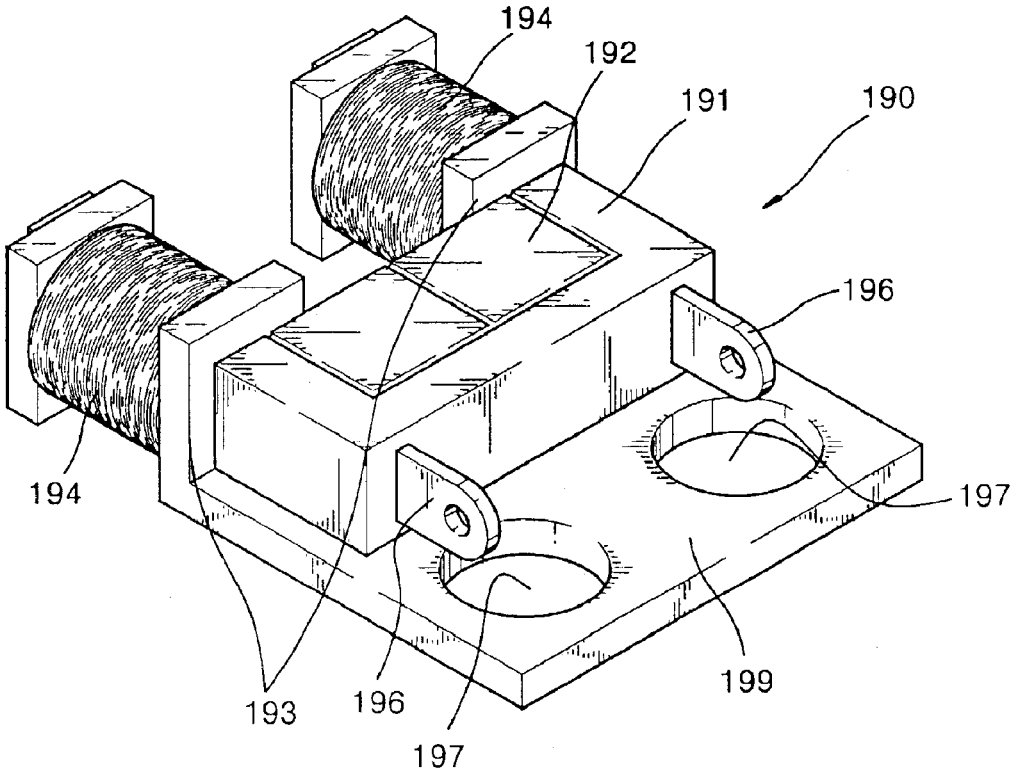
FIGS. 6A and 6B are an enlarged perspective view and a section view, respectively, of an electromagnet of FIG. 4.
Figure 6B:
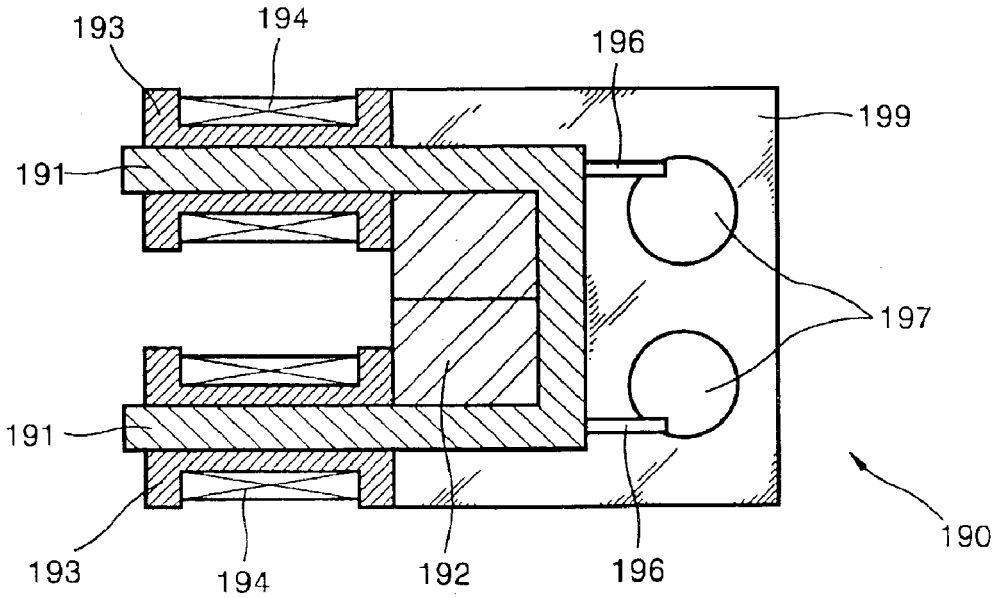

The electromagnet 190 is shown in detail in FIGS. 6A and 6B. The electromagnet 190 shown in FIGS. 6A and 6B is disclosed in Korean Laid-Open Patent Application Publication No. 2000-13010 published on Mar. 6, 2000, filed by the applicant of the present invention.

Referring to FIGS. 6A and 6B, the electromagnet 190 has two cores 191 fixedly installed at a base 199, a permanent magnet 192 installed between the two cores 191, bobbins 193 surrounding the two cores 191 separately, and coils 194 wound around the circumferences of the bobbins 193. In addition, leading ends of the cores 191 project slightly from ends of the bobbins 193. Reference numeral 196 denotes DC input terminals, and reference numeral 197 denotes screw insertion holes.

In the electromagnet 190 configured as described above, when electric power is not applied to the electromagnet 190, a magnetic field is set up around the leading ends of the cores 191 by the magnetic force of the permanent magnet 192. Accordingly, the metal plate 168 is attracted to and contacts the leading ends of the cores 191, and pivoting of the locking lever 160 is restrained. But when electric power is applied to the electromagnet 190, the magnetic field induced by the coils 194 offsets the magnetic field of the permanent magnet 192. Accordingly, the metal plate 168 separates from the leading ends of the cores 191, and the locking lever 160 is allowed to pivot.

Again referring to FIG. 4, the electromagnet 190 is fixedly installed at the external side surface of the main frame 120 with screws 124, and the leading ends of the cores 191 are positioned at the lower end of a vertical movement path of the metal plate 168. Therefore, when the locking lever 160 pivots in the clockwise direction, and the metal plate 168 moves downward, the metal plate 168 contacts the leading ends of the cores 191.

The operation of the carrier locking apparatus having the structure described above will be described with reference to FIGS. 4 and 5.

As shown in FIG. 4, the carrier 110 is out of the home position during the printing operation. The internal frame 154 of the parking apparatus 150 is maintained in the lowered state as described above, and the guide pins 157 of the internal frame 154 are positioned at the lower ends of the guide grooves 153 of the external frame 151. In addition, the locking lever 160 is fully pivoted counter-clockwise, and, accordingly, the latch 162 of the leading end of the locking lever 160 is not in the latch groove 172 of the carrier 110. This state is maintained as it is by the elastic force of the toggle spring 180, as described above.

When the printing operation is completed, the carrier 110 moves in the direction of arrow R, and pushes the parking lever 158. Accordingly, the guide pins 157 move upward along the paths of the respective guide grooves 153, and the internal frame 154 and the caps 155 also move upward.

Subsequently, the carrier 110 pushes the pivoting lever 166 of the locking lever 160, and, the locking lever 160 pivots clockwise around the pivot pin 161. Correspondingly, the latch 162 provided at the leading end of the locking lever 160 begins to move upward, and the two prongs 164 provided at the rear end of the locking lever 160 turn the toggle spring 180 downward while moving downward.

As shown in FIG. 5, when the carrier 110 reaches the home position, the caps 155 are fully raised, and cover the head chips of the ink cartridges 112. Further, the latch 162 of the leading end of the locking lever 160 is inserted into the latch groove 172, and, the carrier 110 is locked in the home position. In addition, the toggle spring 180 is fully turned downward and the elastic force of the toggle spring 180, that is applied to the locking lever 160 as described above, prevents the locking lever 160 from pivoting freely. Further, the engagement of the latch 162 in the latch groove 172 resists external impacts and vibrations applied to the carrier 110, to maintain the carrier 110 in the home position.

At this time, electric power is not applied to the electromagnet 190. A magnetic field, set up by the permanent magnet 192 around the leading ends of the cores 191, attracts the metal plate 168 which contacts the leading ends of the cores 191. Thus, the elastic force of the toggle spring 180 and the magnetic force of the electromagnet 190 are applied to the locking lever 160 to maintain the locking state of the carrier 110.

When a printing operation is requested when the carrier 110 is parked at the home position, the carrier belt 140 is circulated by the driving force of the driving motor 144, and the carrier 110 moves in the direction of arrow F along the guide shaft 130. The carrier 110 moves forward and pushes the un-parking lever 159, and the guide pins 157 move downward along the paths of the guide grooves 153. At the same time, the internal frame 154 and the caps 155 move downward, and the caps 155 separate from the head chips provided at the lower surfaces of the ink cartridges 112.

The driving force of the driving motor 144 causes the carrier 110 to move forward, and also causes the latch 162 of the leading end of the locking lever 160 to escape from the latch groove 172 and to move downward, and thus, the locking lever 160 pivots counter-clockwise. At this time, electric power is applied to the electromagnet 190. Since the magnetic field induced by the coils 194 offsets the magnetic field set up by the permanent magnet 192 around the leading ends of the cores 191, the metal plate 168 separates from the leading ends of the cores 191. Accordingly, the rear end of the locking lever 160 moves upward to cause the toggle spring 180 to turn upward, as shown in FIG. 4. When the counter-clockwise pivoting of the locking lever 160 is completed, the electromagnet 190 is disconnected from the electric power source.

Figure 7:
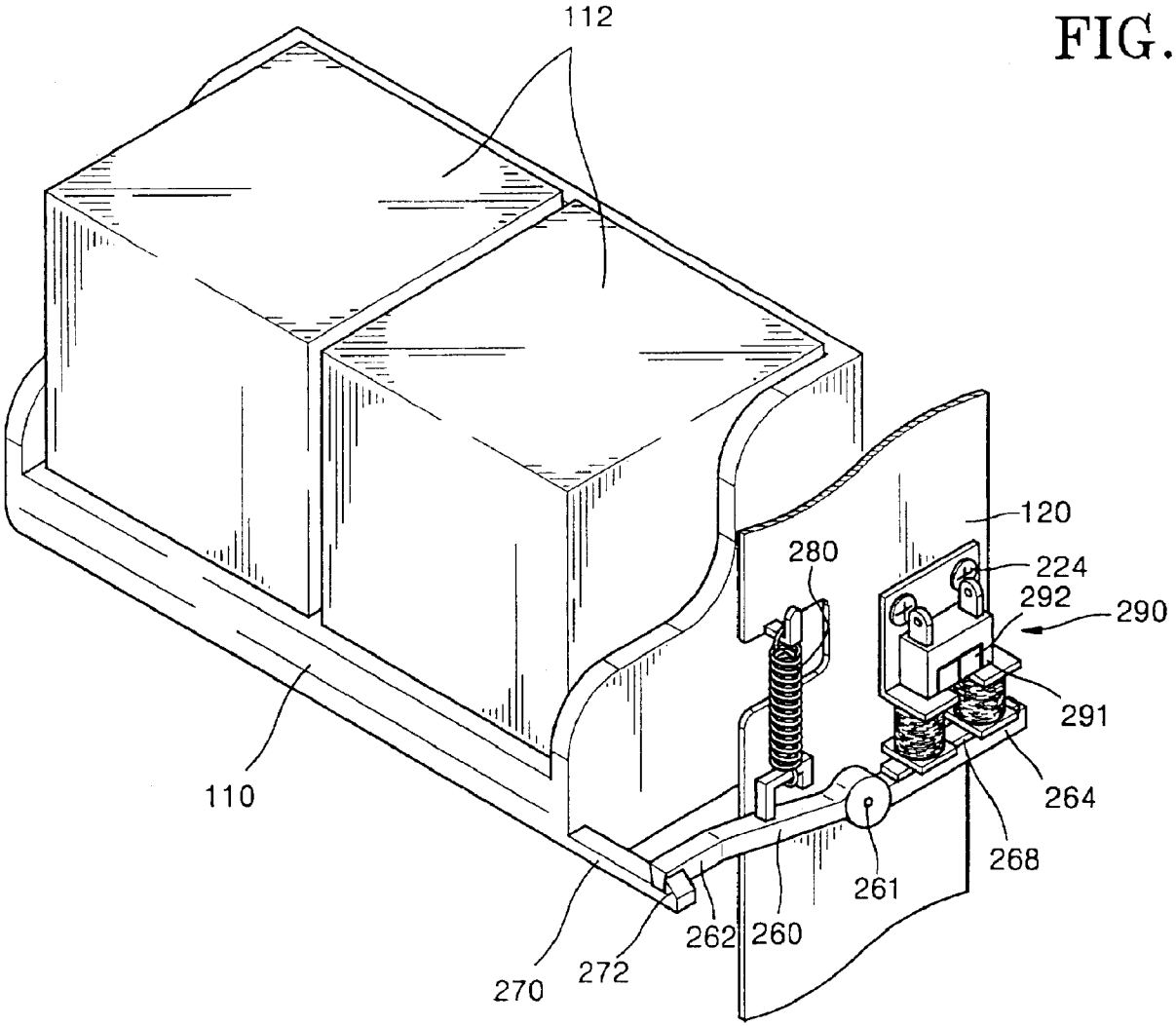
FIGS. 7 and 8 are perspective views illustrating a carrier locking apparatus of an inkjet printer according to a second embodiment of the present invention.
Figure 8:
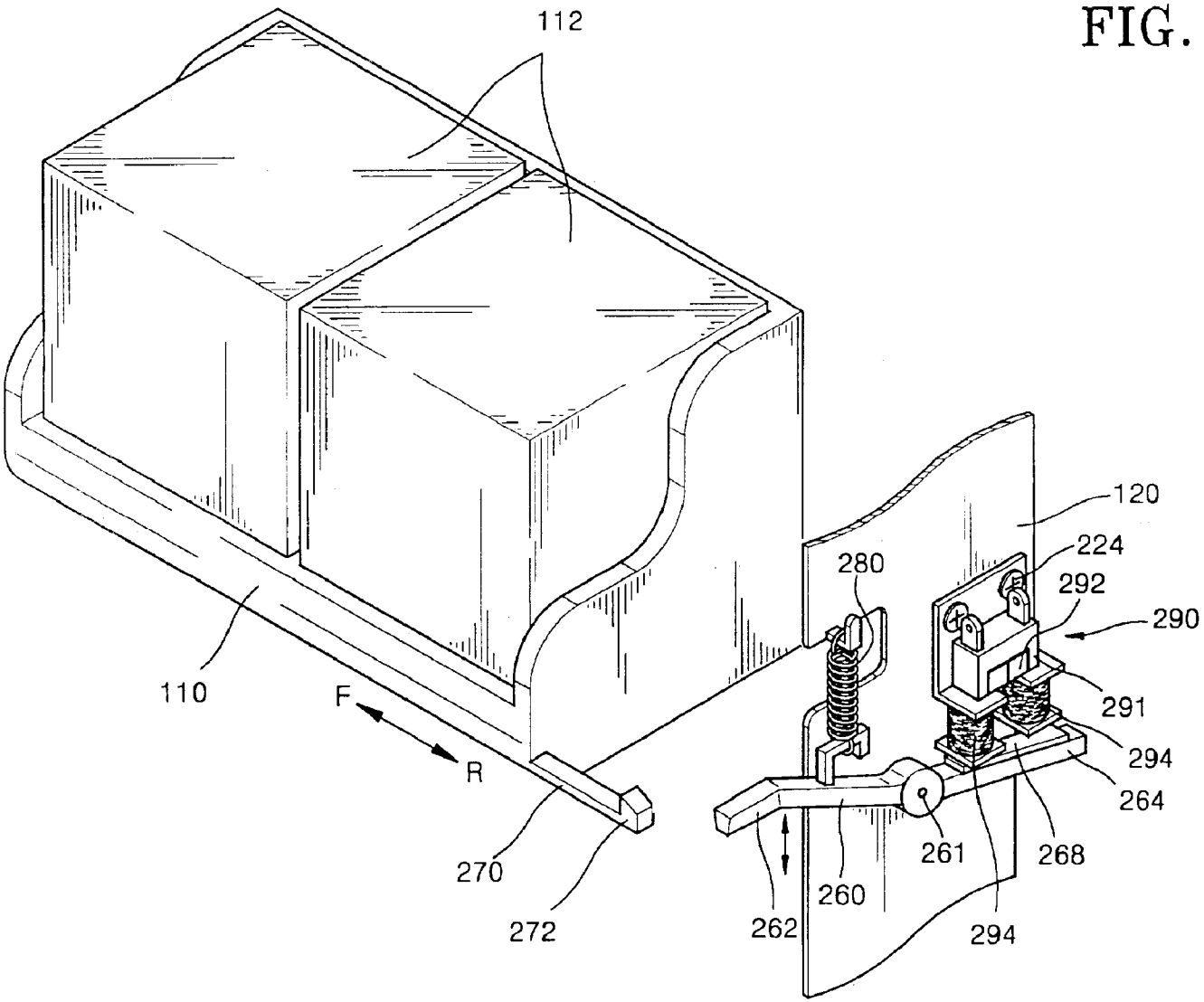

FIGS. 7 and 8 are perspective views illustrating a carrier locking apparatus of an inkjet printer according to a second embodiment of the present invention: FIG. 7 shows a carrier parked at a home position, and FIG. 8 shows a carrier positioned out of the home position. The same reference numerals as in FIGS. 4 and 5 are used to denote those elements performing the same or similar function, and detailed descriptions thereof are omitted.

Referring to FIG. 7, a carrier locking apparatus includes a locking lever 260 pivotably installed at a main frame 120 of a printer, a paramagnetic metal plate 268 provided at a rear end 264 of the locking lever 260, a hook 270 provided at the carrier 110, an elastic member 280 to apply an elastic force to the locking lever 260, and an electromagnet 290 to restrain pivoting movement of the locking lever 260.

A pivot pin 261 is installed at an external side surface of the main frame 120, and the locking lever 260 is assembled to the pivot pin 261 at about the middle of the locking lever 260. When the carrier 110 is parked at the home position, the hook 270 is engaged by a leading end 262 of the locking lever 260. According to one aspect, the metal plate 268 is provided at the rear end 264 of the locking lever 260. According to another aspect, the metal plate 268 is attached to the rear end 264 of the locking lever 260 as a separate member. According to yet another aspect, the locking lever 260 is made of paramagnetic metal and, the metal plate 268 is unnecessary, since the rear end 264 of the locking lever 260 is attracted to and connects to the leading ends of cores 291 of an electromagnet 290 as described below.

According to one aspect, the hook 270 is provided at a front right edge portion of the carrier 110. A hooking projection 272 that engages the leading end of the locking lever 260 projects upward at an end of the hook 270. According to one aspect, the upper surface of the hooking projection 272 is an inclined surface.

The elastic member 280 is connected to the locking lever 260 at a predetermined position, and applies an elastic force to the locking lever 260 in one direction, i.e., in a direction in which the locking lever 260 is disengaged from the hook 270. According to one aspect, when the elastic member 280 is installed at an upper side of the locking lever 260, as shown in FIG. 7, a tension spring is used as the elastic member 280. According to another aspect, when the elastic member 280 is installed at a lower side of the locking lever 260, a compression spring is used as the elastic member 280. The elastic member 280 serves to move the leading end 262 of the locking lever 260 upward, and various types of springs can perform such a job and be used as the elastic member 280, for example, a leaf spring.

The electromagnet 290 has the structure shown in FIGS. 6A and 6B, as in the first embodiment. The electromagnet 290 is fixedly installed on an outer side surface of the main frame 120 with screws 224, and the leading ends of the cores 291 are positioned at the upper end of the vertical movement path of the metal plate 268. Thus, when the locking lever 260 pivots counter-clockwise, and the metal plate 268 is raised, the metal plate 268 contacts the leading ends of the cores 291.

According to one aspect, the carrier locking apparatus is disposed in another direction. That is, the hooking projection projects downward, and in this case, the pivoting direction of the locking lever 260 is changed. Accordingly, the direction of disposing the elastic member 280 and the electromagnet 290 are changed to a direction opposite to that shown in FIG. 7.

Now, the operation of the carrier locking apparatus having the above-described structure according to the second embodiment of the present invention will be described below with reference to FIGS. 7 and 8.

As shown in FIG. 7, when the carrier 110 is parked at the home position, the metal plate 268 attached to the rear end 264 of the locking lever 260 is attracted and attached to the leading ends of the cores 291 of the electromagnet 290, and the hooking projection 272 of the hook 270 is engaged by the leading end 262 of the locking lever 260. At this time, the electromagnet 290 is not connected to the electric power source, and, accordingly, since a magnetic field is set up by the permanent magnet 292 around the leading ends of the cores 291, the metal plate 268 is attracted to and contacts the leading ends of the cores 291. Thus, since the pivoting movement of the locking lever 260 is restrained by the magnetic force of the permanent magnet 292, the hook 270 remains engaged with the locking lever 260, and resists external impacts or vibrations applied to the carrier 110. Accordingly, the carrier 110 remains in the home position.

Next, when the carrier 110 is moved forward (in the direction of arrow F) from the home position to perform a printing job, as shown in FIG. 8, the electromagnet 290 is connected to an electric power source, and the magnetic field induced by the coils 294 offsets the magnetic field set up by the permanent magnet 292 around the leading ends of the cores 291. Accordingly, the metal plate 268 detaches from the leading ends of the cores 291, and the locking lever 260 pivots clockwise due to the elastic force of the elastic member 280. Further, the leading end 262 of the locking lever 260 moves upward, and the hook 270 disengages from the leading end 262 of the locking lever 260 and moves forward in the direction of arrow F together with the carrier 110. When the hook 270 is completely disengaged from the leading end 262 of the locking lever 260, the electromagnet 290 is disconnected from the electric power source. Accordingly, the magnetic field set up by the permanent magnet 292 around the leading ends of the cores 291 of the electromagnet 290 attracts the metal plate 268, which moves upward, and pivots the locking lever 260 counter-clockwise.

When the printing job is completed, the carrier 110 moves backward in the direction of arrow R. According to one aspect, the hook 270 then elastically deforms slightly as the hook 270 pushes the leading end 262 of the locking lever 260. According to another aspect, the leading end 262 of the locking lever 260 then elastically deforms slightly as the hook 270 pushes the lead end 262 of the locking lever 260. Then, the hooking projection 272 of the hook 270 engages the leading end 262 of the locking lever 260 and thus, the carrier 110 returns to the locking state shown in FIG. 7.

As described above, with the locking apparatus of an inkjet printer according to the present invention, since the carrier is not easily separated from the home position although external impact or vibration is applied to the carrier, a stable parking state can be maintained.

Therefore, leakage of ink occurring when the caps are separated from the head chips can be prevented to ensure desirable quality of printing, and shortening of the useful life of the ink cartridge due to unnecessary consumption of ink can be prevented.

In addition, since the caps always cover the head chips while the carrier is parked at the home position, contamination of the head chips and clotting of ink can be prevented and ink jet performance of the head chips can be maintained appropriately for an increased time.

Further, since the carrier is not easily separated from the home position during parking, the carrier and the head chips are less likely to be damaged.

While this invention has been particularly shown and described with reference to preferred embodiments thereof, it will be understood by those skilled in the art that changes may be made in this embodiment without departing from the principles, spirit of the invention, the scope of which is defined in the claims and their equivalents.

What is claimed is:

1. A carrier locking apparatus of an inkjet printer including a reciprocally moving carrier, carrying an ink cartridge, a parking unit provided at a home position of the carrier, the carrier locking apparatus comprising:

a latch groove provided at a predetermined location on the carrier;

a locking lever, which is installed at the parking unit, having a first end provided with a latch, and a second end provided with a pivoting lever; and a toggle spring joined to the second end of the locking lever to apply an elastic force to the locking lever to selectively maintain each of two pivoted states of the locking lever, wherein when the carrier moves to the home position, the carrier pushes the pivoting lever and pivots the locking lever in a first direction, to insert the latch into the latch groove to lock the carrier, and when the carrier moves from the home position, the locking lever pivots in a direction opposite to the first position and disengages the latch from the latch groove to unlock the carrier.

2. The carrier locking apparatus according to claim 1, further comprising:

a metal plate provided at the second end of the locking lever; and an electromagnet provided to selectively attract the metal plate and pivot the locking lever in the first direction to lock the carrier.

3. The carrier locking apparatus according to claim 2, wherein the electromagnet comprises:

two cores;

a permanent magnet installed between the two cores;

two bobbins surrounding the two cores, respectively; and two coils wound around circumferential surfaces of the bobbins.

4. The carrier locking apparatus according to claim 3, wherein:

when the electromagnet is not connected to an electric power source, a magnetic field of the permanent magnet around the leading ends of the cores attracts the metal plate to the leading ends of the cores; and when the electromagnet is connected to an electric power source, a magnetic field of the electromagnet cancels out the magnetic field of the permanent magnet.

5. The carrier locking apparatus according to claim 3, wherein:

the metal plate projects through a main frame of the printer; and the electromagnet is fixedly installed at an outer side surface of the main frame so that leading ends of the cores face the metal plate.

6. The carrier locking apparatus according to claim 2, wherein:

the locking lever is made of metal; and the metal plate is integrated with the locking lever.

7. The carrier locking apparatus according to claim 1, wherein:

a middle portion of the locking lever is joined to a pivot pin installed at an external frame of the parking unit.

8. The carrier locking apparatus according to claim 1, wherein:

the second end of the locking lever has two prongs;

each end of the toggle spring is connected to one of the two prongs; and a middle portion of the toggle spring contacts and is supported by a bracket installed at the main frame of the printer.

9. A carrier locking apparatus of an inkjet printer including a reciprocally moving carrier carrying an ink cartridge, and a main frame, the carrier locking apparatus comprising:

a hook provided at a first end of the carrier;

a locking lever pivotably installed on the main frame, and provided with a metal plate at a first end;

an electromagnet to selectively attract the metal plate and pivot the locking lever in a first direction; and an elastic member to bias the locking lever in a second direction opposite the first direction, wherein when the carrier moves to a home position, the metal plate is attracted to and contacts the electromagnet, the locking lever pivots in the first direction, and the hook engages a second end of the locking lever to lock the carrier, and when the carrier moves from the home position, the electromagnet disconnects from an electric power source, the locking lever is pivoted in the second direction by the elastic force of the elastic member, and the hook disengages from the second end of the locking lever to unlock the carrier.

10. The carrier locking apparatus according to claim 9, wherein the electromagnet comprises:

two cores;

a permanent magnet installed between the two cores;

two bobbins surrounding the two cores, respectively; and two coils wound around circumferential surfaces of the bobbins.

11. The carrier locking apparatus according to claim 10, wherein:

when the electromagnet is not connected to an electric power source, a magnetic field of the permanent magnet around the leading ends of the cores attracts the metal plate to the leading ends of the cores; and when the electromagnet is connected to the electric power source, a magnetic field of the electromagnet cancels out the magnetic field of the permanent magnet.

12. The carrier locking apparatus according to claim 10, wherein the electromagnet is fixedly installed at an outer side surface of the main frame, so that leading ends of the cores face the metal plate.

13. The carrier locking apparatus according to claim 9, wherein:

the locking lever is made of metal; and the metal plate is integrated with the locking lever.

14. The carrier locking apparatus according to claim 9, wherein:

a middle portion of the locking lever is joined to a pivot pin installed at an external frame of the parking unit.

15. The carrier locking apparatus according to claim 9, wherein the elastic member is a tension spring.

16. A carrier locking apparatus of an inkjet printer including a frame, and a movable carrier that holds an ink cartridge, the carrier locking apparatus comprising:

a locking lever, pivotably attached to the frame, having a first end that selectively engages the carrier;

a biasing unit that selectively biases the locking lever in a first lever position, in which the first end of the locking lever does not engage the carrier, and a second lever position, in which the first end of the locking lever engages the carrier;

wherein movement of the carrier into a home position causes the first end of the locking lever to engage the carrier.

17. The carrier locking apparatus according to claim 16, wherein:

the first end of the locking lever comprises a latch; and the carrier comprises a latch groove corresponding to the latch, wherein disposing the latch in the latch groove locks the carrier in the home position.

18. The carrier locking apparatus according to claim 16, wherein the carrier comprises:

a hook that engages the first end of the locking lever when the carrier moves into the home position, and locks the carrier in the home position.

19. The carrier locking apparatus according to claim 18, wherein the hook comprises:

a hooking projection having an inclined surface that initially contacts the first end of the locking lever when the carrier moves into the home position.

20. The carrier locking apparatus according to claim 18, wherein the biasing unit comprises:

an elastic member, connected to the frame and the locking lever, that biases the locking lever toward the first lever position; and an electromagnet that selectively attracts a second end of the locking lever, biasing the locking lever toward the second lever position.

21. The carrier locking apparatus according to claim 20, wherein the electromagnet comprises:

two cores;

a permanent magnet installed between the two cores;

two bobbins surrounding the two cores, respectively; and two coils wound around circumferential surfaces of the bobbins, wherein when power is not applied to the electromagnet, a magnetic field of the permanent magnet around attracts the second end of the locking lever, and the second end of the locking lever contacts the electromagnet, and when power is applied to the electromagnet, the magnetic field is offset, and the electromagnet does not attract the second end of the locking lever.

22. The carrier locking apparatus according to claim 20, wherein the elastic member is a tension spring.

23. The carrier locking apparatus according to claim 20, wherein the elastic member is a compression spring.

24. The carrier locking apparatus according to claim 20, wherein the elastic member is a leaf spring.

25. A carrier locking apparatus of an inkjet printer including a frame, and a movable carrier that holds an ink cartridge, the carrier locking apparatus comprising:

a locking lever, pivotably attached to the frame, having a first end that selectively engages the carrier;

a biasing unit that selectively biases the locking lever in a first lever position, in which the first end of the locking lever does not engage the carrier, and a second lever position, in which the first end of the locking lever engages the carrier;

wherein movement of the carrier into a home position causes the first end of the locking lever to engage the carrier, the locking lever comprises a pivoting lever, and as the carrier moves into the home position, the carrier engages the pivoting lever, causing the locking lever to pivot.

26. The carrier locking apparatus according to claim 25, wherein the biasing unit comprises:

a toggle spring, wherein when the locking lever is in the first position, the toggle spring applies an elastic force to maintain the locking lever in the first position, and when the locking lever is in the second position, the toggle spring applies an elastic force to maintain the locking lever in the second position.

27. The carrier locking apparatus according to claim 26, wherein:

the biasing unit further comprises an electromagnet; and a second end of the locking lever is attracted to the electromagnet when power is not applied to the electromagnet.

28. The carrier locking apparatus according to claim 27, wherein the electromagnet comprises:

two cores;

a permanent magnet installed between the two cores;

two bobbins surrounding the two cores, respectively; and two coils wound around circumferential surfaces of the bobbins, wherein when power is not applied to the electromagnet, a magnetic field of the permanent magnet attracts the second end of the locking lever, and the second end of the locking lever contacts the electromagnet, and when power is applied to the electromagnet, the magnetic field is offset, and the electromagnet does not attract the second end of the locking lever.

29. The carrier locking apparatus according to claim 28, wherein:

the second end of the locking lever is made of a paramagnetic metal.

30. The carrier locking apparatus according to claim 28, wherein:

the second end of the locking lever further comprises a paramagnetic metal plate.

31. A carrier locking apparatus of an inkjet printer including a frame with a cartridge cap, and a movable carrier that holds an ink cartridge with a head chip, the carrier locking apparatus comprising:

a guide to guide the carrier;

a mover to move the carrier along the guide;

a locking lever, pivotably attached to the frame, having a first end that selectively engages the carrier;

a biasing unit that selectively biases the locking lever in a first lever position, in which the first end of the locking lever does not engage the carrier, and a second lever position, in which the first end of the locking lever engages the carrier;

wherein movement of the carrier into a home position causes the first end of the locking lever to engage the carrier and lock the carrier in the home position.

32. The carrier locking apparatus according to claim 31, wherein the mover comprises:

a driving motor;

a driving pulley;

a driven pulley;

a carrier belt that engages the carrier and moveably engages the driving pulley and the driven pulley, wherein the driving motor rotates the driving pulley, the driving pulley moves the carrier belt, and the carrier belt moves the carrier along the guide.

33. A carrier locking apparatus of an inkjet printer including a frame, and a movable carrier that holds an ink cartridge, the carrier locking apparatus comprising:

a locking lever, pivotably attached to the frame, having a first end selectively engaging the carrier; and a biasing unit to selectively maintain each of two pivoted states of the locking lever, wherein movement of the carrier into a home position causes the first end to engage the carrier.

* * * * *

UNITED STATES PATENT AND TRADEMARK OFFICE

CERTIFICATE OF CORRECTION

PATENT NO. : 6,926,383 B2
DATED : August 9, 2005
INVENTOR(S) : Deuk-hwan Chang

It is certified that error appears in the above-identified patent and that said Letters Patent is hereby corrected as shown below:

Column 10,
Line 31, after "around" delete "the";

Column 11,
Line 28, after "around" delete "the".

Signed and Sealed this

Seventh Day of March, 2006

JON W. DUDAS
*Director of the United States Patent and Trademark Office*